US006624401B2

(12) United States Patent
Kitaizumi et al.

(10) Patent No.: US 6,624,401 B2
(45) Date of Patent: Sep. 23, 2003

(54) MAGNETRON DRIVE POWER SUPPLY

(75) Inventors: Takeshi Kitaizumi, Toyonaka (JP); Haruo Suenaga, Katano (JP); Hideaki Moriya, Yamatokoriyama (JP); Emiko Ishizaki, Nabari (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/161,368

(22) Filed: Jun. 3, 2002

(65) Prior Publication Data

US 2002/0179597 A1 Dec. 5, 2002

(30) Foreign Application Priority Data

Jun. 4, 2001 (JP) ..... P. 2001-167985

(51) Int. Cl.[7] ..... H05B 6/68

(52) U.S. Cl. ..... 219/716; 219/723; 323/319; 363/96; 315/219

(58) Field of Search ..... 219/716, 715, 219/702, 717, 718, 721, 723, 761; 323/319, 235, 236; 363/16, 49, 74, 96, 97; 315/200, 209 R, 219

(56) References Cited

U.S. PATENT DOCUMENTS 4,931,609 A * 6/1990 Aoki ..... 219/716
5,115,168 A * 5/1992 Shoda et al. ..... 315/223
5,639,395 A * 6/1997 Lee ..... 219/716

* cited by examiner

*Primary Examiner*—Philip H. Leung
(74) *Attorney, Agent, or Firm*—Pearne & Gordon LLP

(57) ABSTRACT

Timing of zero voltage in zero-voltage detector for detecting zero voltage of a commercial power supply 1 is predicted and input from the zero-voltage detector 6 is received only for a given time before and after the predicted timing, whereby overvoltage and overcurrent caused by a zero point shift can be prevented. Thus, it is provided a magnetron drive power supply which is excellent in stability for change in the power supply environment such as noise or instantaneous power interruption.

3 Claims, 8 Drawing Sheets

MAGNETRON DRIVE POWER SUPPLY

BACKGROUND OF THE INVENTION

This invention relates to a magnetron drive power supply with a magnetron of a microwave oven, etc., as a load.

A magnetron drive power supply in a related art will be discussed with reference to the accompanying drawings (FIGS. 8 and 9). FIG. 8 is a circuit block diagram of a magnetron drive power supply in a related art. A semiconductor switch in a high-frequency inverter 2 is controlled by controller 7, whereby a commercial power supply 1 is converted into radio-frequency power of 20 to 50 kHz and the radio-frequency power is supplied to a high-voltage transformer 3. A high-voltage rectification circuit 4 and a magnetron 5 are connected to the secondary side of the high-voltage transformer 3 and a DC high voltage is applied to the magnetron 5 for generating a 2.45-GHz radio wave.

Zero-voltage detector 6 detects a zero voltage point of the power supply voltage 1 and causes modulation signal generator 9 to generate a modulation waveform responsive to the power supply phase. Upon reception of input of zero voltage detection from the zero-voltage detector 6, the modulation signal generator 9 outputs a modulation waveform of one period of the power supply voltage 1 as a peak value responsive to the setup value of input current. Using such a modulation signal, the controller 7 can control the input current to the form close to a sine wave. The controller 7 performs 20 to 50-kHz PWM modulation of the modulation signal by oscillator 10 and transmits the signal to driver 8, thereby controlling the on-duration of the semiconductor switch in the high-frequency inverter 2. As the zero-voltage detector 6, voltage detection with a transformer using a photocoupler, etc. is available. And, as the controller 7, control of a microcomputer, etc., is used.

FIGS. 9A to 9D are waveform charts of the magnetron drive power supply in the related art. Upon reception of a signal of commercial power supply (FIG. 9A), a signal of zero voltage detection (FIG. 9B) oscillated at the timing of zero voltage is output by the zero-voltage detector 6. The rising edge of the signal of the zero-voltage detector 6 is detected and a modulation signal (FIG. 9C) preset so that the input current becomes a predetermined value and moreover the power factor of the input current becomes close to 1 is output for one period of the commercial power supply 1. The modulation signal (FIG. 9C) is compared with the oscillation frequency of oscillator output (FIG. 9D) by comparator 11, whereby the signal is subjected to PWM modulation and is supplied to the driver 8 as a drive signal. The modulation signal is set so that the frequency of the semiconductor switch in the high-frequency inverter 2 becomes 20 to 50 kHz. The controller 7 performs such control, whereby electric power having a current waveform with a less harmonic component with a good power factor can be supplied.

However, in the magnetron drive power supply in the related art, if the zero voltage detection shifts due to noise, instantaneous power interruption, etc., the modulation waveform deviates from the essential timing and a possibility of leading to a failure of the high-frequency inverter because of overvoltage, overcurrent, etc., occurs.

SUMMARY OF THE INVENTION

It is therefore an object of the invention to provide a magnetron drive power supply which is resistant to change in the power supply environment and can operate stably.

According to the first aspect of the invention, there is provided a magnetron drive power supply comprising: a commercial power supply; a high-frequency inverter which converts electric power of the commercial power supply into high-frequency power and supplies the high-frequency power to a high-voltage transformer; a high-voltage rectification circuit and a magnetron being connected to secondary output of the high-voltage transformer; zero-voltage detector which detects zero voltage of the commercial power supply; and controller which controls the high-frequency inverter in response to output of the zero-voltage detector, wherein the controller predicts the detection timing of zero voltage by the zero-voltage detector in each period and enables the output from the zero-voltage detector to be received only for a given time before and after the predicted detection timing.

Thus, even if the zero-voltage detector or the power supply voltage carries noise, the voltage zero point is not largely mistaken, so that overcurrent, overvoltage, etc., does not occur and the magnetron drive power supply that can stably operate can be realized.

Preferably, if the given time before and after the predicted detection timing contains a period in which the output from the zero-voltage detector is not received, it is assumed that the output from the zero-voltage detector is received, and controlling the high-frequency inverter is continued.

Thus, it is made possible to continue the operation with safety if short-time instantaneous power interruption of the commercial power supply occurs, and the magnetron drive power supply that can stably operate without stopping an inverter unnecessarily can be realized.

Preferably, if a period in which the output from the zero-voltage detector is not received occurs successively a stipulated number of times in the given time before and after the predicted detection timing, the controller stops the high-frequency inverter.

Thus, it is made possible to stop the inverter with safety if comparatively long-time instantaneous power interruption of the commercial power supply occurs, and the magnetron drive power supply that can operate without a failure caused by a power outage can be realized.

According to the second aspect of the invention, there is provided a magnetron drive power supply comprising: a commercial power supply; a high-frequency inverter which converts electric power of the commercial power supply into high-frequency power and supplies the high-frequency power to a high-voltage transformer; a high-voltage rectification circuit and a magnetron being connected to secondary output of the high-voltage transformer; input current detector which detects the current value of the high-frequency inverter; and controller which controls the high-frequency inverter, wherein if the detection value of the input current detector has a predetermined difference from a target value continuously for a given time, the controller stops the high-frequency inverter.

Thus, it is made possible to detect the power supply voltage lowering without detecting the input voltage, and the magnetron drive power supply having the voltage lowering protection function can be realized at low cost.

Preferably, the predetermined difference between the detection value of the input current detector and the target value is set in response to the target value.

Thus, it is made possible to detect the input voltage of the commercial power supply lowering almost at constant voltage independently of the input current, and the magnetron drive power supply having the voltage lowering protection function can be realized at low cost.

Figure 1:
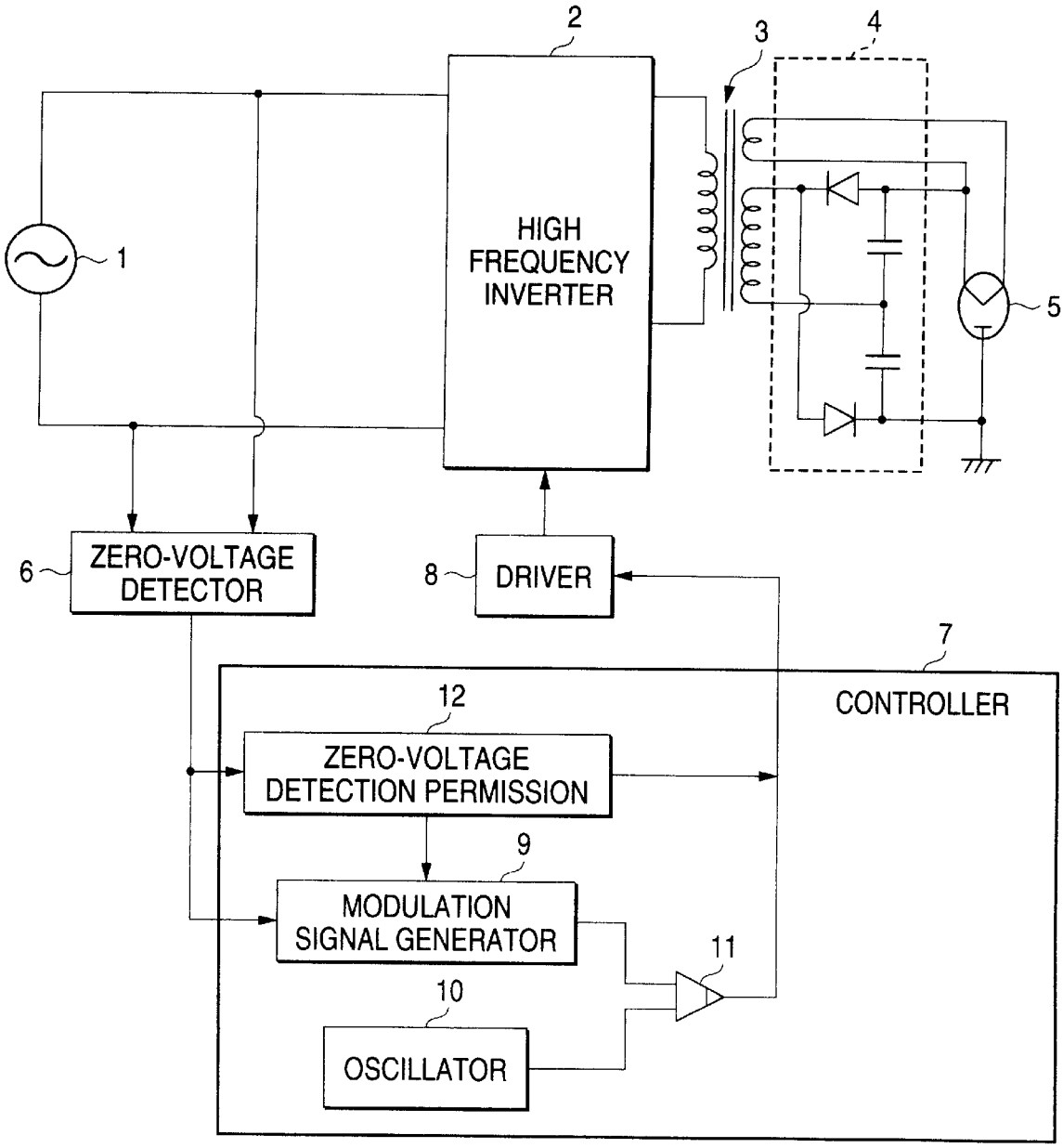
FIG. 1 is a diagram to show the circuit configuration of a magnetron drive power supply in a first embodiment of the invention.

In the drawings, the reference numerals defines as follow, 1, Commercial power supply; 2, High-frequency inverter; 3, High-voltage transformer; 4, High-voltage rectification circuit; 5, Magnetron; 6, Zero-voltage detector; 7, Controller; 8, Driver; 9, Modulation signal generator; 10, Oscillator; 11, Comparator; 12, Zero-voltage detection permission means; 13, Input current detector; 14, Command value signal; 15, Error determination means; and 16, Modulation signal MAX definition means.

DETAILED DESCRIPTION OF THE PREFERRED EMBODIMENTS

First Embodiment

Figures 2A, 2B, 2C, 2D:
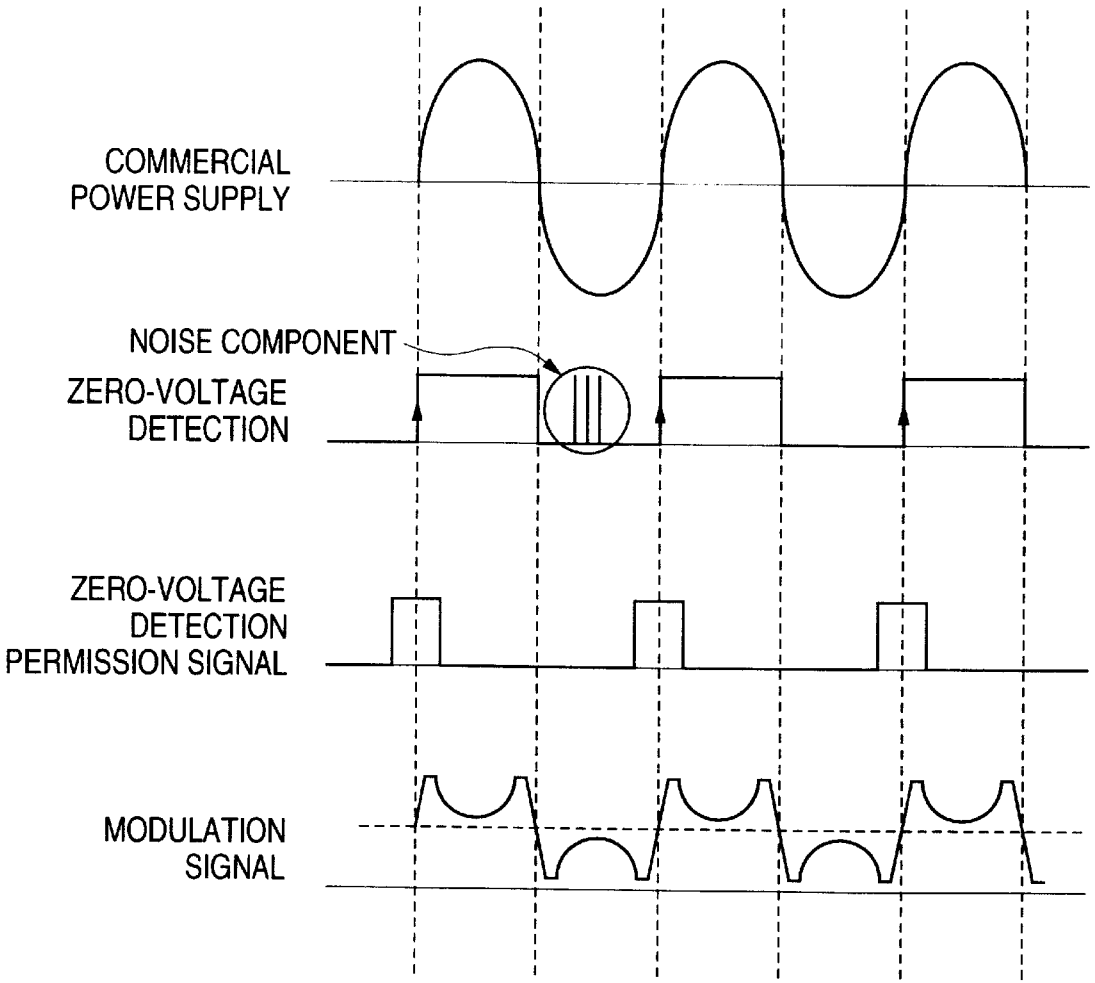
FIGS. 2A to 2D are charts to show operation waveforms of the magnetron drive power supply in the first embodiment of the invention.
Figures 3A, 3B, 3C, 3D:
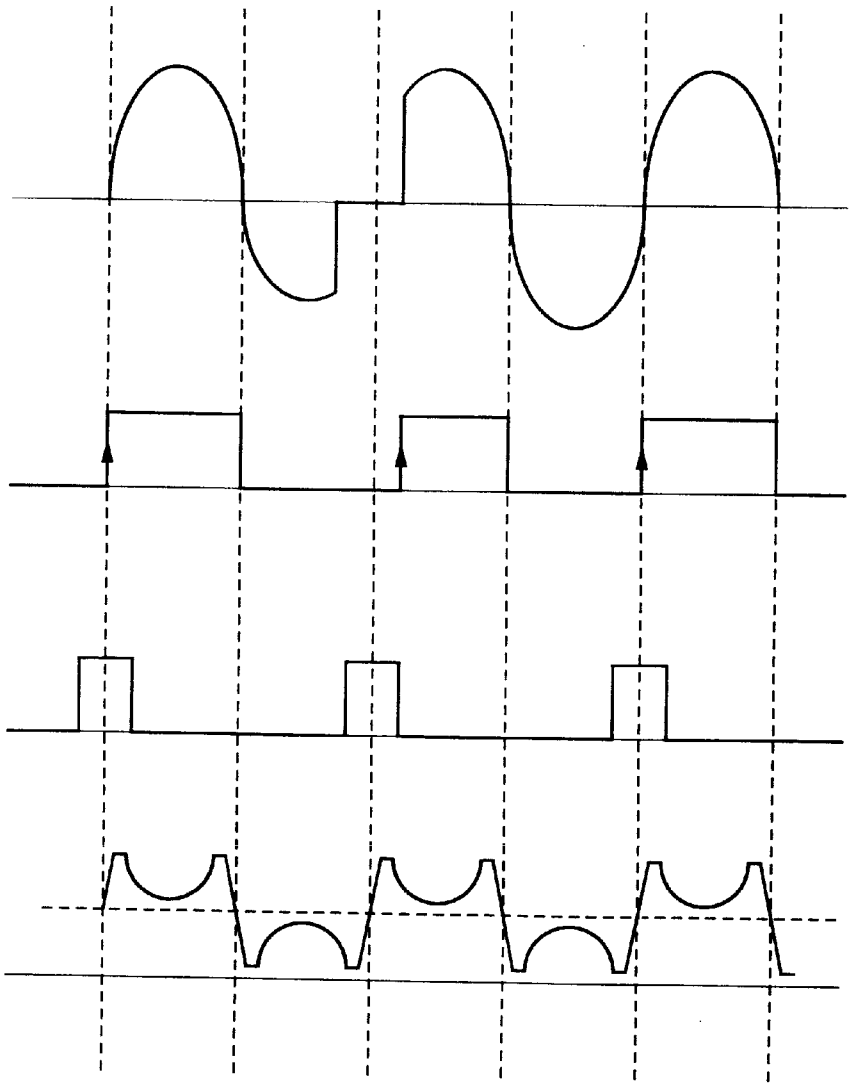
FIGS. 3A to 3D are charts to show operation waveforms of a magnetron drive power supply in a second embodiment of the invention.
Figures 4A, 4B, 4C, 4D, 4E:
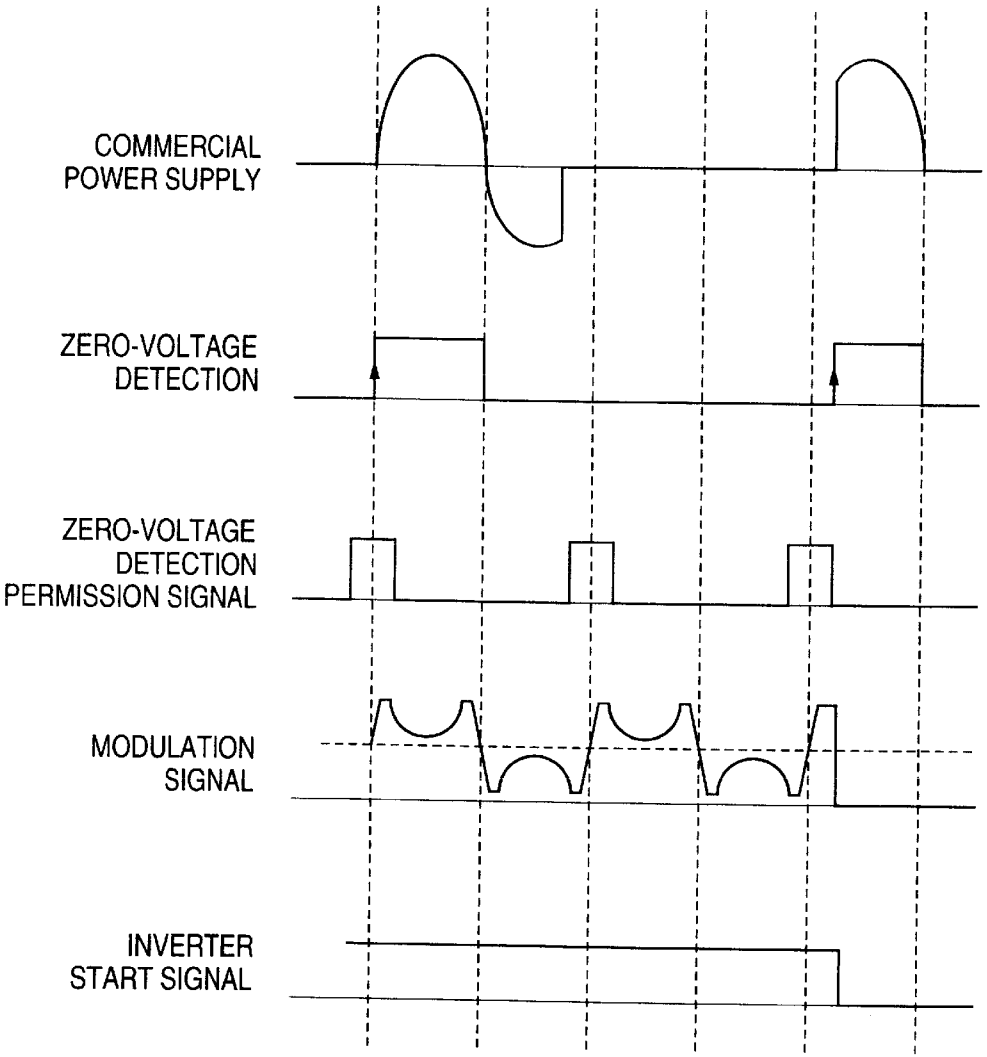
FIGS. 4A to 4E are charts to show operation waveforms of a magnetron drive power supply in a third embodiment of the invention.
Figure 8:
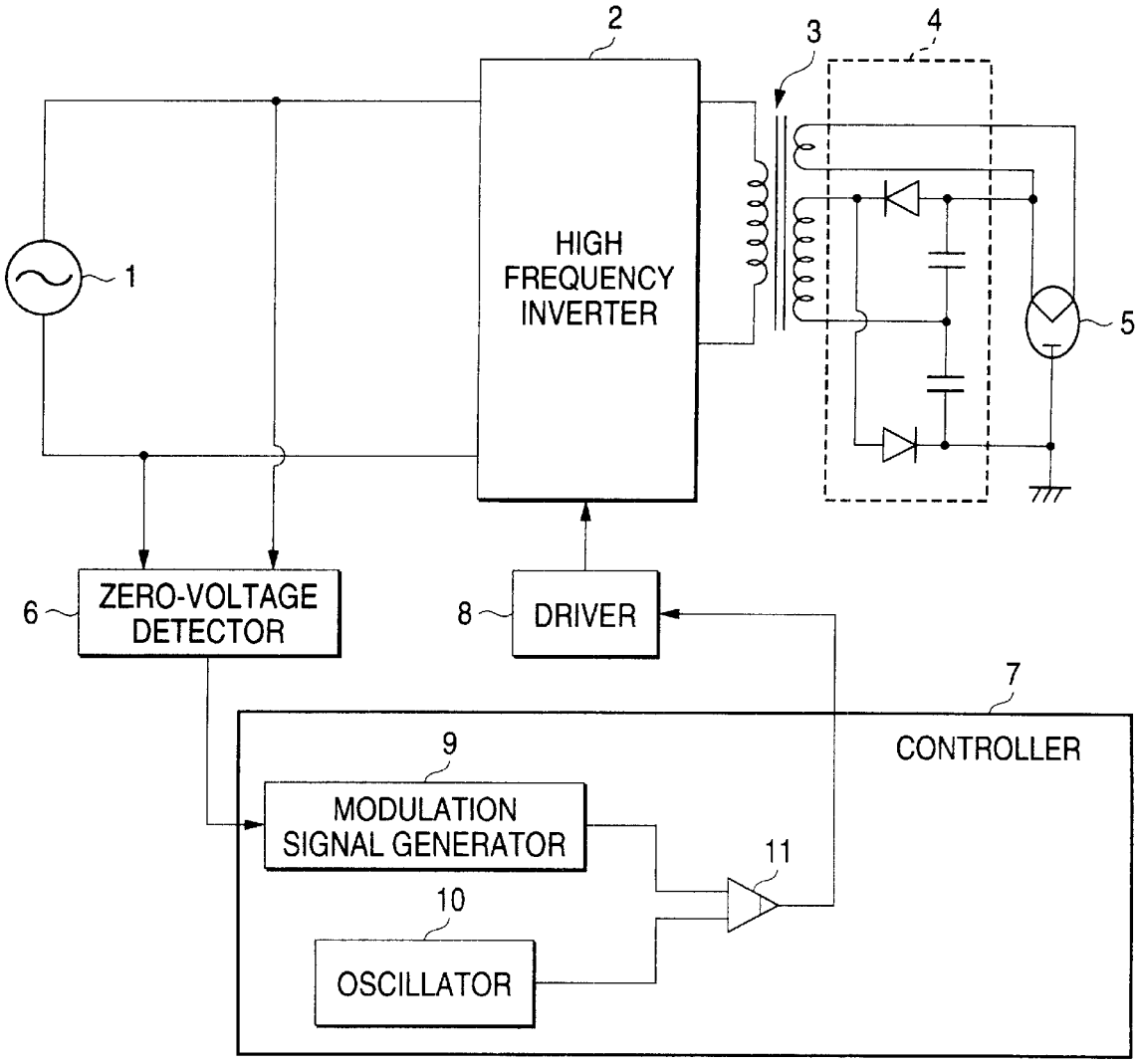
FIG. 8 is a diagram to show the circuit configuration of a magnetron drive power supply in a related art.
Figures 9A, 9B, 9C, 9D:
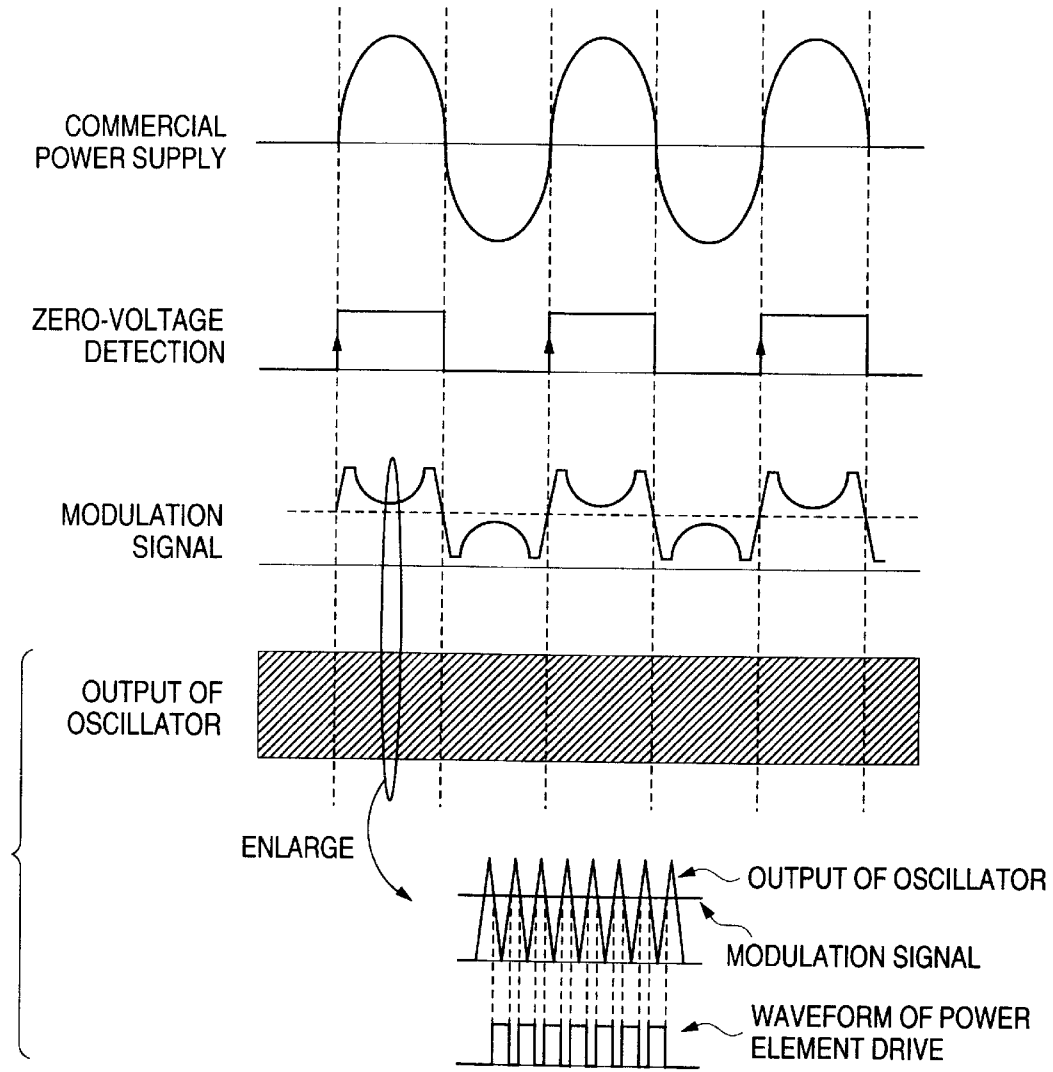
FIGS. 9A to 9D are charts to show operation waveforms of the magnetron drive power supply in the related art.

A first embodiment of the invention will be discussed with reference to the accompanying drawings (FIGS. 1 and 2). FIG. 1 shows the circuit configuration of a magnetron drive power supply of the first embodiment of the invention. Parts identical with those previously described with reference to FIG. 8 are denoted by the same reference numerals in FIG. 1 and will not be discussed again in detail.

In FIG. 1, a commercial power supply 1 transmits high-frequency power through a high-frequency inverter 2 to a high-voltage transformer 3. A high-voltage rectification circuit 4 is connected to secondary winding output of the high-voltage transformer 3 for applying a DC high voltage to a magnetron 5. The magnetron 5 generates a 2.45-GHz radio wave based on the DC high voltage. Zero-voltage detector 6 which detects the timing of zero voltage of the commercial power supply is connected to an output section of the commercial power supply 1 and further controller 7 which controls the on-time of a semiconductor switch in the high-frequency inverter 2 in accordance with a signal of the zero-voltage detector 6 and a current command value is connected to output of the zero-voltage detector 6. Further, driver 8 which actually giving a drive signal to the semiconductor switch in the high-frequency inverter 2 upon reception of a signal from the controller 7 is connected to the controller 7.

The controller 7 is made up of modulation signal generator 9 which determines a modulation signal of the on-time of the semiconductor switch in the high-frequency inverter 2 in accordance with the signal of the zero-voltage detector 6, zero-voltage detection permission means 12 for permitting reception of the signal of the zero-voltage detector 6, oscillator 10 which outputs an oscillation waveform for determining the operation frequency of the semiconductor switch, comparator 11 which compares between signals from the modulation signal generator 9 and the oscillator 10 and generates a drive signal supplied to the semiconductor switch, and the like.

Next, the operation of the embodiment is as follows: Electric power supplied from the commercial power supply 1 is supplied through the semiconductor switch in the high-frequency inverter 2 to the high-voltage transformer 3 as high-frequency power of 20 to 50 kHz. The high-frequency power is rectified by the high-voltage rectification circuit 4 connected to the secondary side of the high-voltage transformer 3 for supplying a high DC voltage to a magnetron 5. The magnetron 5 oscillates at 2.45 GHz based on the DC voltage.

On the other hand, the controller 7 receives the zero phase timing from the zero-voltage detector 6 detecting the timing of zero voltage of the commercial power supply 1 and outputs a modulation waveform preset so that the target current value, the input current, and the power factor become good for one period of the power supply by the modulation signal generator 9. At this time, if the position of zero voltage is erroneously recognized due to restoration from instantaneous power interruption, noise, etc., trouble such that control to be performed at the peak of the power supply period is performed at the valley occurs and trouble such that the high-frequency inverter 2 fails due to overcurrent, overvoltage, etc., occurs. Thus, the timing at which zero voltage occurs is almost preknown from the period of the commercial power supply 1 and thus signal is accepted only for 1 to 2 msec before and after it is predicted that zero voltage will come by the zero-voltage detection permission means 12. Accordingly, it is made possible to prevent erroneous detection of the zero-voltage timing because of restoration from instantaneous power interruption, noise, etc. The comparator 11 compares the modulation signal output from the modulation signal generator 9 with the oscillation waveform at a frequency of 20 to 50 kHz output from the oscillator 10 and supplies a drive signal to the driver 8 as a PWM signal. As the zero-voltage detector 6, a method of using a transformer, a method of using a photocoupler, etc., is possible, but the zero-voltage detector 6 is not limited.

FIGS. 2A to 2D are waveform charts of the magnetron drive power supply of the embodiment. Upon reception of a signal of commercial power supply (FIG. 2A), a signal of zero voltage detection (FIG. 2B) oscillated at the timing of zero voltage is output by the zero-voltage detector 6. The rising edge of the signal of the zero-voltage detector 6 is detected and a modulation signal (d) preset so that the input current becomes a predetermined value and moreover the power factor of the input current becomes close to 1 is output for one period of the commercial power supply 1. If the signal cannot be received for the time of 1 to 2 msec before and after the predicted reception timing of a zero-voltage period of the commercial power supply 1 provided to accept the signal by the zero-voltage detection permission means 12, the signal from the zero-voltage detector 6 is not accepted. Thus, noise, etc., is removed. The modulation signal (FIG. 2D) is compared with the oscillation frequency of oscillator output by comparator 11, whereby the signal is subjected to PWM modulation and is supplied to the driver 8 as a drive signal.

As described above, according to the embodiment, if the zero-voltage detector 6 or the power supply voltage 1 carries noise, the voltage zero point is not largely mistaken, so that overcurrent, overvoltage, etc., does not occur and the magnetron drive power supply that can stably operate can be realized.

Second Embodiment

A second embodiment of the invention will be discussed with reference to the accompanying drawing (FIGS. 3A to 3D). FIGS. 3A to 3D show operation waveforms of a magnetron drive power supply of the second embodiment of the invention. The circuit configuration of the embodiment is similar to that previously described with reference to FIG. 1 and detailed description of reference numerals, etc., is not given.

As shown in FIGS. 3A to 3D, in the second embodiment, if a signal does not come at the timing at which a signal from zero-voltage detector 6 should essentially come, due to instantaneous power interruption, etc., of commercial power supply (FIG. 3A) (zero-voltage waveform shown in (FIG. 3B)), controller 7 predicts the timing at which the zero-voltage detection signal comes, and outputs a modulation signal (FIG. 3D) by assuming that the zero-voltage signal comes at the timing. Accordingly, it is made possible to continue the operation with Safety if short instantaneous power interruption of about several msec occurs.

As described above, in the embodiment, it is made possible to continue the operation with safety if short-time instantaneous power interruption of the commercial power supply occurs, and the magnetron drive power supply that can stably operate without stopping an inverter unnecessarily can be realized.

Third Embodiment

A third embodiment of the invention will be discussed with reference to the accompanying drawing (FIGS. 4A to 4E). FIGS. 4A to 4E show operation waveforms of a magnetron drive power supply of the third embodiment of the invention. The circuit configuration of the embodiment is similar to that previously described with reference to FIG. 1 and detailed description of reference numerals, etc., is not given.

As shown in FIGS. 4A to 4E, in the third embodiment, if commercial power supply (FIG. 4A) enters a power outage state for a comparatively long time because of instantaneous power interruption, etc., namely, if a signal from zero-voltage detector 6 does not come exceeding the stipulated number of times, controller 7 determines that instantaneous power interruption occurs, and stops a high-frequency inverter 2. Accordingly, it is made possible to stop the inverter with safety when comparatively long instantaneous power interruption occurs. The system of determining the on-time waveform for power supply period with the zero voltage, etc., as the reference as in the system is excellent in stability and the operation continues with safety if comparatively long instantaneous power interruption occurs, but there is a possibility that power supply, etc., of the controller 7 will become unstable, and thus the inverter is stopped.

As described above, according to the embodiment, it is made possible to stop the inverter with safety if comparatively long-time instantaneous power interruption of the commercial power supply occurs, and the magnetron drive power supply that can operate without a failure caused by a power outage can be realized.

Fourth Embodiment

Figure 5:
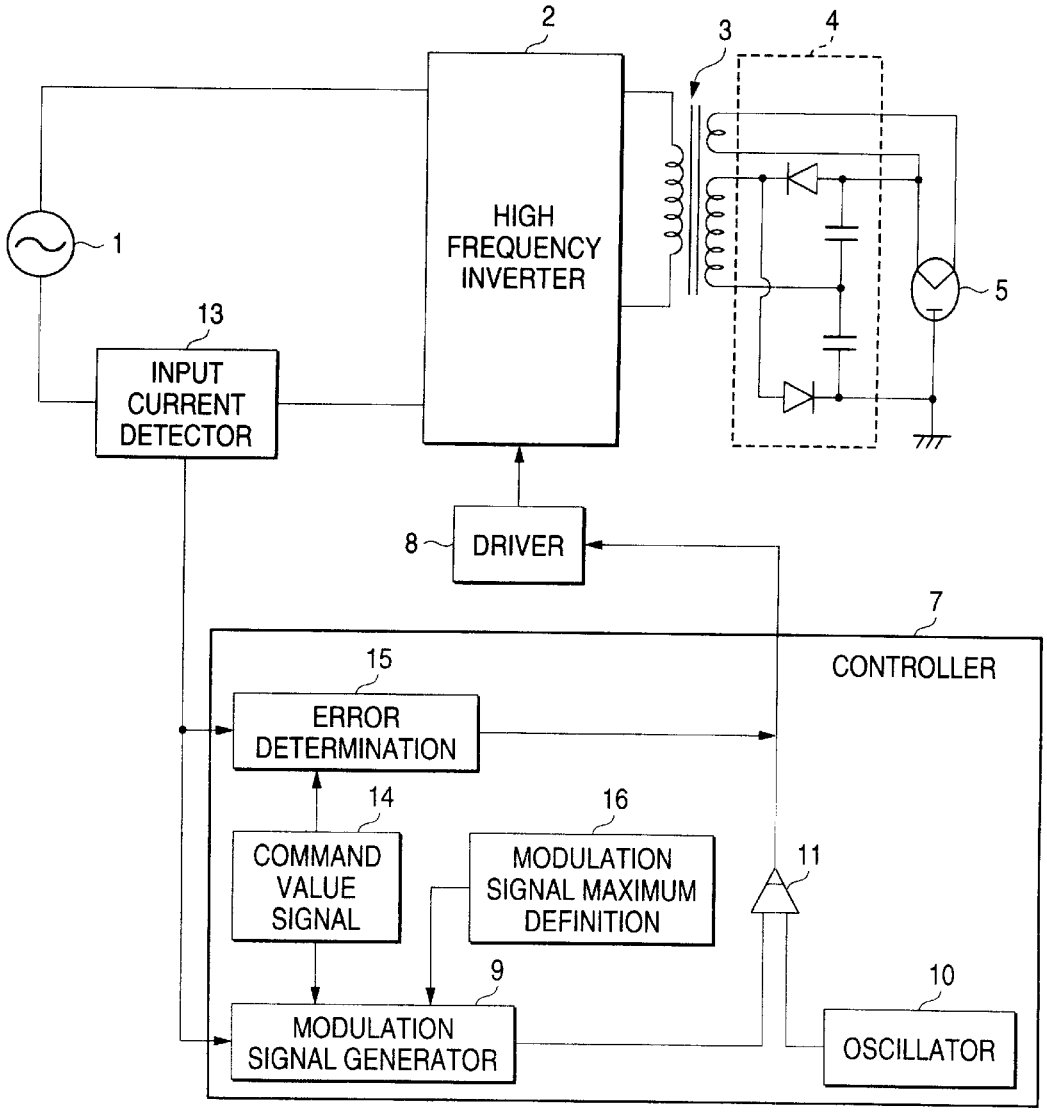
FIG. 5 is a diagram to show the circuit configuration of a magnetron drive power supply in a fourth embodiment of the invention.
Figure 6:
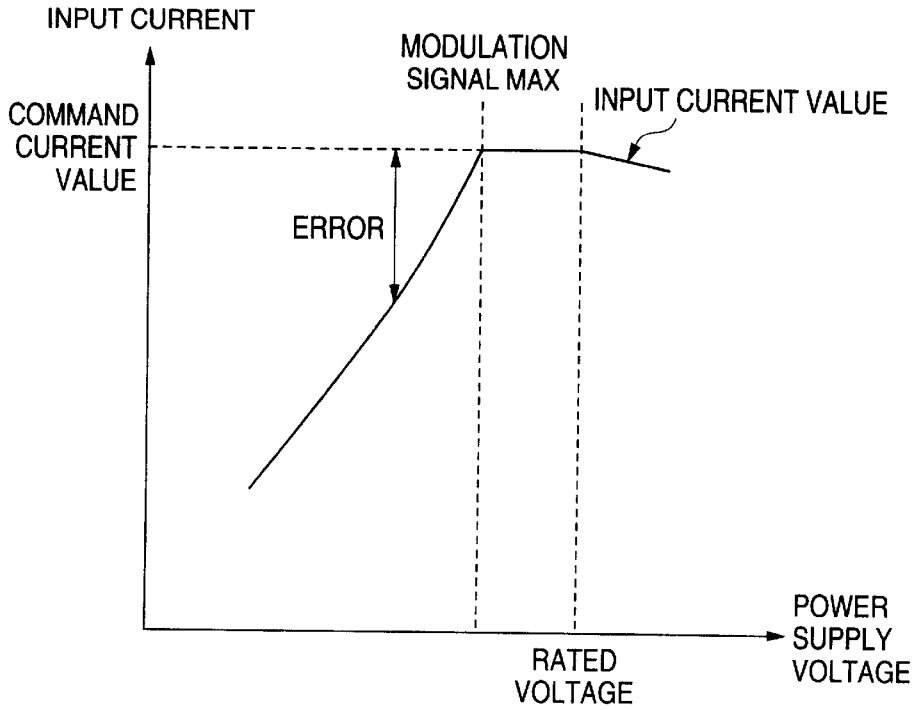
FIG. 6 is a drawing to show the operation characteristic of the magnetron drive power supply in the fourth embodiment of the invention.

A fourth embodiment of the invention will be discussed with reference to the accompanying drawings (FIGS. 5 and 6). FIG. 5 shows the circuit configuration of a magnetron drive power supply of the fourth embodiment of the invention. Parts identical with those previously described with reference to FIG. 8 are denoted by the same reference numerals in FIG. 1 and will not be discussed again in detail.

In FIG. 5, a commercial power supply 1 transmits high-frequency power through a high-frequency inverter 2 to a high-voltage transformer 3. A high-voltage rectification circuit 4 is connected to secondary winding output of the high-voltage transformer 3 for applying a DC high voltage to a magnetron 5. The magnetron 5 generates a 2.45-GHz radio wave based on the DC high voltage. Input current detector 13 for detecting an input current is connected to an output section of the commercial power supply 1 and further controller 7 for controlling the on time of a semiconductor switch in the high-frequency inverter 2 in accordance with a command value signal 14 determining the command current value of the input current is connected to output of the input current detector 13. Further, driver 8 for actually giving a drive signal to the semiconductor switch in the high-frequency inverter 2 upon reception of a signal from the controller 7 is connected to the controller 7.

The controller 7 is made up of modulation signal generator 9 for determining a modulation signal of the on time of the semiconductor switch in the high-frequency inverter 2 in accordance with the command value signal 14, modulation signal MAX definition means 16 for determining the upper limit value of the modulation signal generator 9, oscillator 10 for outputting an oscillation waveform for determining the operation frequency of the semiconductor switch, comparator 11 for making a comparison between signals from the modulation signal generator 9 and the oscillator 10 and generating a drive signal supplied to the semiconductor switch, error determination means 15 which determines the error between the command value signal 14 and the detection value of the input current detector 13, and the like.

Next, the operation of the embodiment is as follows: Electric power supplied from the commercial power supply 1 is Supplied through the semiconductor switch in the high-frequency inverter 2 to the high-voltage transformer 3 as high-frequency power of 20 to 50 kHz. The high-frequency power is rectified by the high-voltage rectification circuit 4 connected to the secondary side of the high-voltage transformer 3 for supplying a high DC voltage to a magnetron 5. The magnetron 5 oscillates at 2.45 GHz based on the DC voltage.

On the other hand, the controller 7 generates a modulation signal by the modulation signal generator 9 so that the command current value set by the command value signal 14 is reached. The comparator 11 compares the modulation signal output from the modulation signal generator 9 with the oscillation waveform at a frequency of 20 to 50 kHz output from the oscillator 10 and supplies a drive signal to the driver 8 as a PWM signal. If the voltage of the commercial power supply 1 lowers, when an attempt is made to ensure the current value of the command value, it is necessary to set long the on time of the semiconductor switch in the high-frequency inverter 2 and it becomes difficult to ensure the voltage resistance of the semiconductor switch. Thus, the upper limit of the on time is defined by the modulation signal MAX definition means 16, whereby if the voltage of the commercial power supply 1 lowers, the input current can be suppressed and it is made possible to prevent exceeding the voltage resistance of the semiconductor switch, etc. If an error of a given value or more remains between the input current and the command value, it is seen that the voltage of the commercial power supply 1 lowers.

Seeing the error, it is made possible to recognize that the power supply voltage lowers without detecting the voltage of the commercial power supply 1.

FIG. 6 shows the relationship of the error between the input current value and the command value (target value) when the voltage of the commercial power supply 1 lowers. From the figure, it is seen that if the current value decreases as the power supply voltage lowers and an error of a given value or more continues, it is assumed that the voltage of the commercial power supply 1 decreases.

As described above, according to the embodiment, it is made possible to detect the power supply voltage lowering without detecting the input voltage, and the magnetron drive power supply having the voltage lowering protection function can be realized at low cost.

Fifth Embodiment

Figure 7:
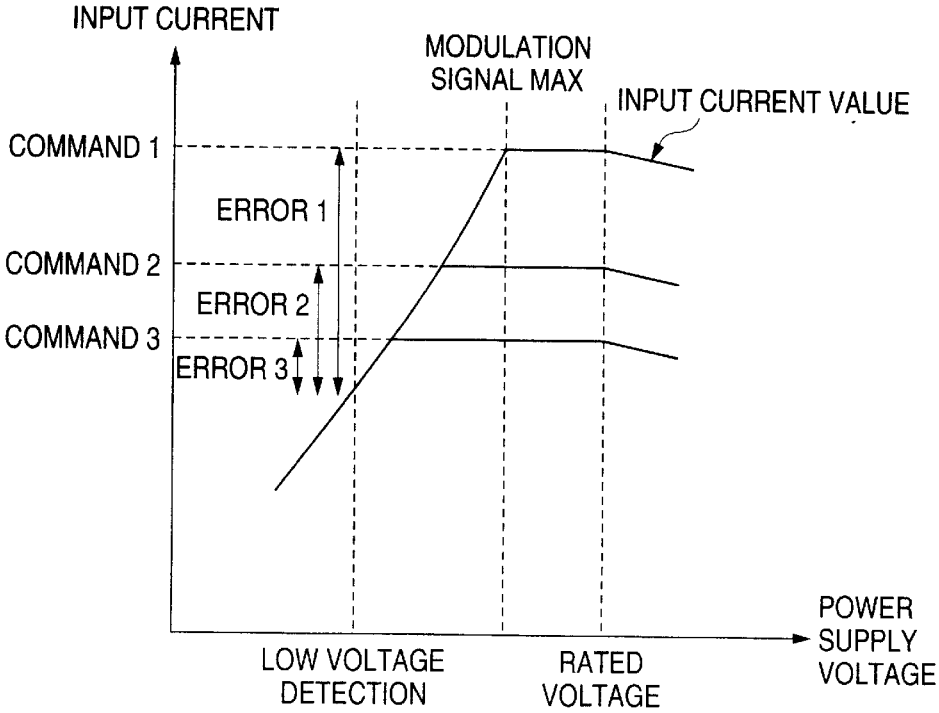
FIG. 7 is a drawing to show the operation characteristic of a magnetron drive power supply in a fifth embodiment of the invention.

A fifth embodiment of the invention will be discussed with reference to the accompanying drawing (FIG. 7). FIG. 7 shows the characteristic of a magnetron drive power supply of the fifth embodiment of the invention. The circuit configuration of the embodiment is similar to that of the fourth embodiment previously described with reference to FIG. 5 and detailed description of reference numerals, etc., is not given.

As shown in FIG. 7, in the fifth embodiment, the tolerance (predetermined difference) of an error from the current value detected by current detector 13 according to the command value of a command value signal 14 is changed for each command value (target value). For the command value with a large input current, if the voltage of a commercial power supply 1 lowers, a modulation signal reaches the maximum value early and thus the error of the current value exceeds predetermined tolerance where the voltage is comparatively high. On the other hand, for the command value with a small input current, if the voltage of the commercial power supply 1 lowers, the modulation signal reaches the maximum value late and thus the error is hard to exceed the tolerance and unless the commercial power supply 1 lowers considerably, the commercial power supply 1 lowering cannot be detected. Then, the tolerance is changed for each command value, whereby the voltage lowering detection level of the commercial power supply 1 can be made almost constant. To set the tolerance, several levels may be provided for each command value or replacement with a function involves no problem; as the command current value increases, the tolerance needs to be set larger.

As described above, according to the embodiment, it is made possible to detect the input voltage of the commercial power supply 1 lowering almost at constant voltage independently of the input current, and the magnetron drive power supply having the voltage lowering protection function can be realized at low cost.

As seen from the embodiments described above, according to the invention, if the zero-voltage detector or the power supply voltage carries noise, the voltage zero point is not largely mistaken, so that overcurrent, overvoltage, etc., does not occur and the magnetron drive power supply that can stably operate can be realized.

It is made possible to detect the power supply voltage lowering without detecting the input voltage, and the magnetron drive power supply having the voltage lowering protection function can be realized at low cost.

What is claimed is:

1. A magnetron drive power supply comprising:

a commercial power supply;

a high-frequency inverter which converts electric power of the commercial power supply into high-frequency power and supplies the high-frequency power to a high-voltage transformer;

a high-voltage rectification circuit and a magnetron being connected to secondary output of the high-voltage transformer;

zero-voltage detector which detects zero voltage of the commercial power supply; and controller which controls the high-frequency inverter in response to output of the zero-voltage detector, wherein the controller predicts the detection timing of zero voltage by the zero-voltage detector in each period and enables the output from the zero-voltage detector to be received only for a given time before and after the predicted detection timing.

2. The magnetron drive power supply as claimed in claim 1 wherein, when the given time before and after the predicted detection timing contains a period in which the output from the zero-voltage detector is not received, it is assumed that the output from the zero-voltage detector is received, and controlling the high-frequency inverter is continued.

3. The magnetron drive power supply as claimed in claim 2 wherein, when a period in which the output from the zero-voltage detector is not received occurs successively a stipulated number of times in the given time before and after the predicted detection timing, the controller stops the high-frequency inverter.

* * * * *